US005656887A

United States Patent [19]

Voshell et al.

[11] Patent Number: 5,656,887

[45] Date of Patent: Aug. 12, 1997

[54] HIGH EFFICIENCY FIELD EMISSION DISPLAY

[75] Inventors: Thomas W. Voshell; Glen E. Hush, both of Boise, Id.

[73] Assignee: Micron Display Technology, Inc., Boise, Id.

[21] Appl. No.: 513,544

[22] Filed: Aug. 10, 1995

[51] Int. Cl.[6] ..... H01J 29/46

[52] U.S. Cl. ..... 313/496; 313/495; 313/422; 313/103 CM; 313/105 CM

[58] Field of Search ..... 313/495, 496, 313/497, 422, 103 CM, 105 CM

[56] References Cited

U.S. PATENT DOCUMENTS

| | | | |
|---|---|---|---|
| 4,020,376 | 4/1977 | Bosserman et al. | 313/103 CM |
| 4,024,390 | 5/1977 | Bosserman et al. | 250/213 VT |
| 4,577,133 | 3/1986 | Wilson | 313/422 |
| 4,698,555 | 10/1987 | Knapp et al. | 313/422 |
| 5,136,153 | 8/1992 | Komiya et al. | 250/213 VT |
| 5,190,365 | 3/1993 | Cordy, Jr. | 362/26 |
| 5,267,062 | 11/1993 | Bottorf | 359/40 |
| 5,378,963 | 1/1995 | Ikeda | 313/495 |

*Primary Examiner*—Nimeshkumar Patel
*Attorney, Agent, or Firm*—Seed and Berry LLP

[57] ABSTRACT

In a field emission display, a microchannel plate is mounted between an emitter panel and a display screen. The inner walls of the cylindrical passageways through the microchannel plate are coated with a conductive layer which is connected to a plate voltage. Electrons emitted from the emitter panel travel through cylindrical passageways in the microchannel plate toward the display screen. As electrons pass through the microchannels, the electrons are multiplied and collimated to increase the intensity of the light emitted from the screen and to reduce the pixel size.

13 Claims, 2 Drawing Sheets

HIGH EFFICIENCY FIELD EMISSION DISPLAY

This invention was made with government support under Contract No. DABT-63-93-C-0025 by Advanced Research Projects Agency (ARPA). The government has certain rights to this invention.

TECHNICAL FIELD

The present invention relates to field emission displays, and more particularly, to field emission displays including a microchannel plate.

BACKGROUND OF THE INVENTION

Flat panel displays are widely used in a variety of applications, including computer displays. One type of device suited for such applications is the field emission display. Field emission displays typically include a generally planar substrate having an array of projecting emitters. In many cases, the emitters are conical projections integral to the substrate. Typically, the emitters are grouped into emitter sets where the bases of the emitters in the emitter sets are commonly connected. A conductive extraction grid is positioned above the emitters and driven with a voltage of about 30 V–120 V. The emitter sets are then selectively activated by connecting the emitter sets to ground. Grounding the emitter sets creates an electric field between the emitters and the extraction grid of any intensity that is sufficient to extract electrons from the emitters and it also provides a current path between the emitters and ground.

The field emission display also includes a display screen mounted adjacent the substrates. The display screen is formed by a glass plate coated with a transparent conductive material to form an anode biased to about 1–2 kV. A cathodoluminescent layer covers the exposed surface of the anode. The emitted electrons are attracted by the anode, and they strike the cathodoluminescent layer causing the cathodoluminescent layer to emit light at the impact site. The emitted light then passes through the glass plate and the anode where it is visible to a viewer.

The brightness of the light produced in response to the emitted electrons depends, in part, upon the rate at which the electrons strike the cathodoluminescent layer, which in mm depends upon the magnitude of the emitter current. The brightness of each area can thus be controlled by controlling the current flow to the respective emitter set. By selectively controlling the current flow to the emitter sets, the light from each area of the display can be controlled and an image can be produced. The light emitted from each of the areas thus becomes all or part of a picture element or "pixel."

One problem in such field emission displays is spreading of the electrons as they are emitted from the emitters. When the emitters emit electrons, not all of the electrons travel directly toward the anode. Instead, the electrons may spread out as they travel toward the anode. As a result, when the emitter set is activated, the area of the cathodoluminescent layer struck by the electrons may be larger than the desired size of the pixel. Consequently, the light emitted from the area may "bleed" into an adjacent pixel, causing loss of resolution and picture quality.

Additionally, the number of electrons emitted from the emitter may sometimes be insufficient to produce sufficient brightness of the pixel. Various techniques have been applied to improve the efficiency of electron emission from the emitters. For example, emitters have been coated with a material having a low work function to increase the emission of electrons from the emitters. However, to the inventor's knowledge, no attempts have been made to provide a gain element in the path between the emitters and the anode to increase the number of electrons striking the cathodoluminescent layer.

SUMMARY OF THE INVENTION

A field emission display includes a planar emitter panel having several emitter sets on the surface of a substrate. A conductive metal layer forming an extracting grid has formed therein. The holes aligned with respective emitters so that the grid forms an equipotential surface surrounding the emitters. The extraction grid is connected to a potential of approximately 30–120 V, and the emitters are selectively grounded through a conductor in the substrate. When the emitters are grounded, the differential voltage between the emitters and the extraction grid produces an intense electric field around the emitters causing the emitters to emit electrons.

Electrons emitted from the emitters are dram toward a transparent conductive anode on a glass plate that forms part of a display screen. The surface of the transparent conductive anode facing the emitters is covered by a cathodoluminescent layer. Electrons traveling toward the anode strike the cathodoluminescent layer causing the cathodoluminescent layer to emit light. The emitted light passes through the anode and the glass plate to a viewer.

A microchannel plate is positioned between the display screen and the emitter panel in the path of the electrons as they travel toward the display screen. The microchannel plate is a dielectric plate having several cylindrical passageways therethrough. The inner walls of the passageways are covered with a conductive layer biased to a plate voltage. As electrons travel upwardly to the anode, they pass through the cylindrical passageways. Some of the electrons strike the conductive walls of the passageways. In response to the electrons, the walls emit additional electrons such that the microchannel plate functions as an electron multiplier.

The electrons emitted by the microchannel plate travel toward the display screen and strike the cathodoluminescent layer along with the electrons emitted by the emitters. In addition to acting as an electron multiplier, the microchannels, because of their cylindrical shape, act as wave guides to help collimate the electrons traveling toward the anode. This limits the divergence of the electrons and helps to concentrate the electrons on a smaller area of the cathodoluminescent layer. The concentration of electrodes within a smaller region improves the resolution of the display screen and minimizes "bleeding" between pixels.

DETAILED DESCRIPTION OF THE INVENTION

Figure 1:
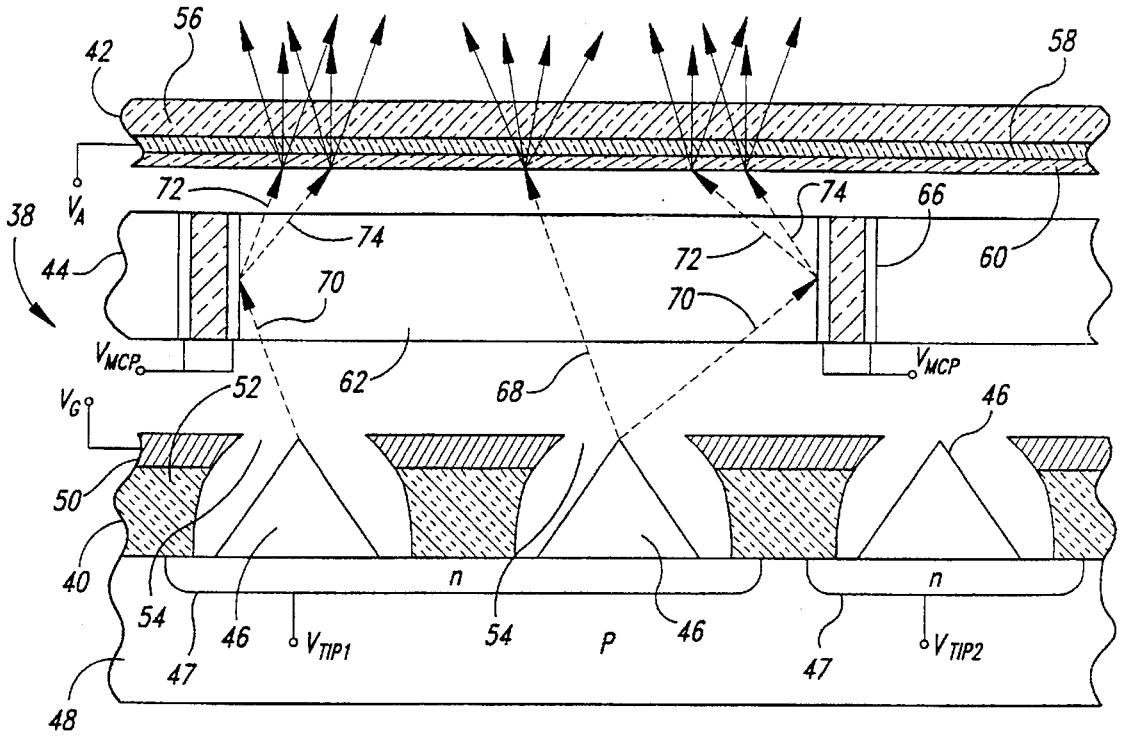
FIG. 1 is a side cross-sectional view of a portion of a preferred embodiment of the inventive high efficiency field emission display.

As shown in FIG. 1, a field emission display 38 according to the invention includes an emitter panel 40, a screen assembly 42, and a microchannel plate 44. The emitter panel .40 is a conventional field emissive array having several emitters 46 projecting from p-type semiconductor substrate 48 toward the screen assembly 42. A layer 47 of n-type material within the substrate 48 provides a conductive path to allow a voltage $V_{TIP}$ to be applied to the emitters 46.

The n-type layer 47 is broken into individual sections, with each section including a set of emitters 46. Each section of the n-type layer 47 can thus be used to independently control a distinct set of emitters 46. The emitter panel 40 also includes a conductive extraction grid 50 supported above the substrate 48 by an insulative layer 52. Concentric apertures 54 are formed in the insulative layer 52 and extraction grid 50 into which respective emitters 46 project. The extraction grid 50 allows a grid voltage $V_G$ to be established near the emitters 46 to produce an electric field extending from the grid 50 to the emitters 46. As is known, if the electric field is sufficiently intense, the electric field induces the emitters 46 to emit electrons according to the Fowler-Nordheim equation. The intensity of the electric field, and thus the quantity of emitted electrons, is controlled by controlling the voltage $V_{TIP}$ of each of the sets of emitters 46 through the respective sections of the n-type layer 47.

The screen assembly 42 is positioned above the emitter panel 40 leaving a gap therebetween which is evacuated prior to use. The screen assembly 42 includes a glass plate 56 having a transparent conductive anode 58 on its lower surface. An anode voltage $V_A$ on the order of 1–2 kV is applied to the anode 58 to attract electrons emitted by the emitters 46.

A cathodoluminescent layer 60 covers the anode 58 so that electrons traveling toward the anode 58 pass through the cathodoluminescent layers. When the electrons strike the cathodoluminescent layer 60, the cathodoluminescent layer 60 emits light. The light passes through the anode 58 and the glass plate 56 where it is visible to an observer. The fabrication and operation of such screen assemblies 42 and emitter panels 40 is known in the art.

Figure 2:
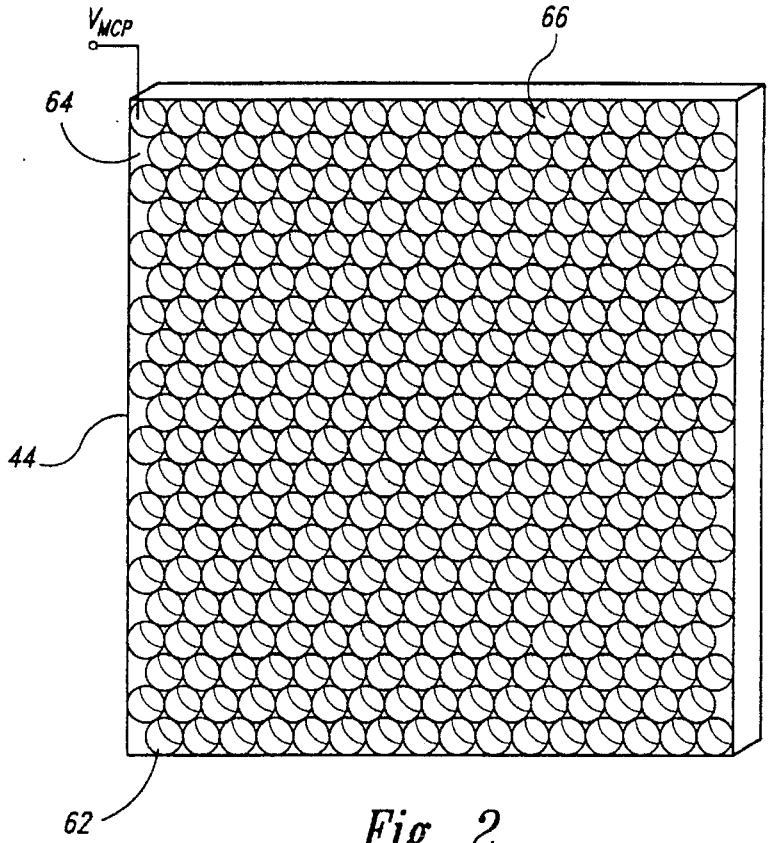
FIG. 2 is an isometric view of a microchannel plate used in the field emission display of FIG. 1.

Unlike conventional field emissive displays, the field emissive display 38 of FIG. 1 includes the microchannel plate 44 between the emitter panel 40 and the screen assembly 42. Microchannel plates are known electron multiplier devices, being described for instance in U.S. Pat. No. 4,020,376 to Bosserman et at. As is shown in the isometric view of FIG. 2, the microchannel plate 44 includes a dielectric plate 64 in which a large number of tiny cylindrical passageways, or microchannels 62, are formed. Typically, the length of the microchannels 62 is considerably larger than their widths. However, in FIG. 1 the width of the microchannels 62 relative to their length is shown to exaggerated scale for clarity of presentation. Thin layers 66 of a conductive (e.g. metal) material coat the inner surfaces of each of the cylindrical passageways such that the inner walls of the microchannels 62 define conductive passageways. The conductive layers 66 are all connected to a plate voltage $V_{MCP}$ at a voltage level between the anode voltage $V_A$ and the grid voltage $V_G$.

As can be seen in FIG. 1, one of the microchannels 62 provides a path for electrons to travel from a pair of emitters 46 to the cathodoluminescent layer 60. While FIG. 1 shows the microchannel 62 encircling only two emitters 46 for clarity of presentation, it will be understood that each microchannel 62 may be aligned to only one emitter 46 or may encircle many emitters 46.

The effect of the microchannel plate 44 is best explained by considering its effect on emitted electrons. When electrons are emitted from the emitters 46, they travel toward the anode 58 as discussed above. As indicated by the arrow 68, some electrons may travel substantially unaffected through the microchannel 62 toward the anode 58. These electrons strike the cathodoluminescent layer 60 causing it to emit light. The light travels through the transparent anode 58 and the glass plate 56 toward an observer.

As indicated by the arrows 70, in some cases the electrons emitted from the emitters 46 strike the conductive layer 66 on the inner wall of the microchannel 62. These electrons may be reflected by the conductive layer 66 toward the anode 58, as indicated by the arrows 72. The reflected electrons strike the cathodoluminescent layer 60, causing the cathodoluminescent layer 60 to emit light.

Additionally, because the conductive layer 66 is highly charged due to the plate voltage $V_{MCP}$, the electrons striking the conductive layer 66 cause additional electrons to be emitted by the conductive layer 66. As indicated by the arrows 74, these additional electrons also travel toward the cathodoluminescent layer 60, causing the cathodoluminescent layer 60 to emit light. Thus, the microchannel plate 44 acts as an electron multiplier, or gain element, to increase the number of electrons striking the cathodoluminescent layer 60. The increased number of electrons increases the mount of light emitted by the cathodoluminescent layer 60.

In addition to acting as electron multipliers, the microchannels 62 help to concentrate the electrons in small areas of the cathodoluminescent layer 60 by reflecting some of the electrons toward the centers of the microchannels 62. The microchannels 62 thus act to collimate the flow of electrons toward the screen 42, concentrating the electrons in the region directly above the emitters 46. Because the microchannels 62 act as guides to help reduce the lateral spread of the flow of electrons traveling toward the anode 58, the area of the cathodoluminescent layer 60 struck by electrons from the emitters 46 is reduced. This reduces "bleeding" of light between pixels, improving the resolution of the field emission display 38.

Figure 3:
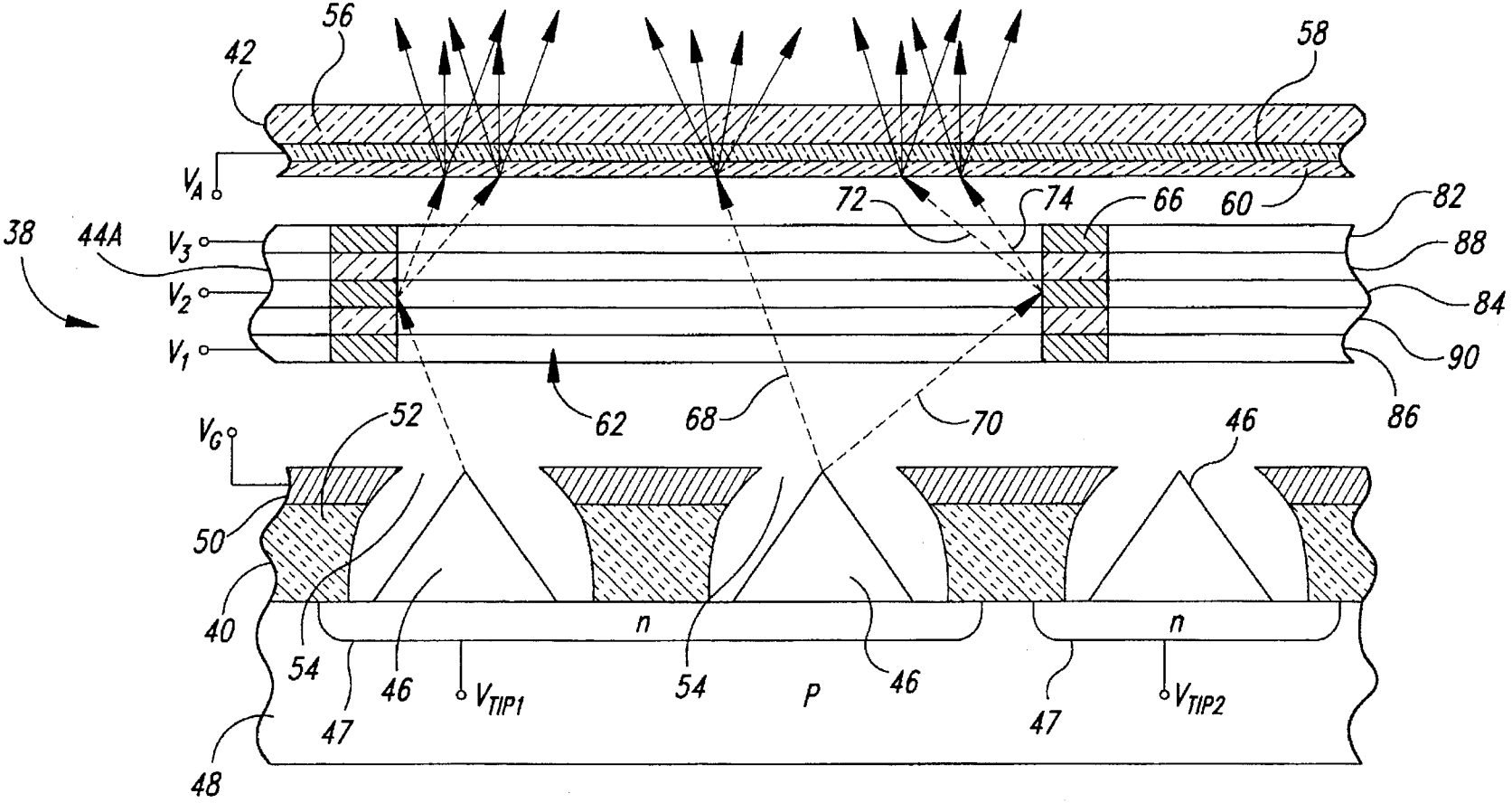
FIG. 3 is a side cross-sectional view of a portion of an alternative embodiment of the high efficiency field emission display having multiple microchannel plates.

An alternative display 80, shown in FIG. 3, is similar to the display 38 of FIG. 1, except that the display 80 employs a five-layer microchannel plate 44A rather than the single microchannel plate 44. Because many elements of the alternative display 80 are identical to those of the display 38 of FIG. 1, corresponding elements are numbered identically.

The display 38 differs principally in the structure and operation of the five-layer microchannel plate 44A. The five-layer microchannel plate 44A includes three spaced apart conductive layers 82, 84, 86 separated by two insulative layers 88, 90 in a stacked configuration. Each of the conductive layers 82, 84, 86 is connected to a respective voltage $V_1$, $V_2$ or $V_3$, where $V_1<V_2<V_3$. The voltages $V_1$, $V_2$, $V_3$ are between the grid voltage $V_G$ and the anode voltage $V_A$.

As with the embodiment of FIG. 1, the microchannels 62 pass through the microchannel plate 80 to provide paths for the emitted electrons to travel from the emitters 46 to the anode 58. The electrons pass directly through the microchannel 62 or may strike the inner wall of the microchannel 62. If the electrons strike one of the charged conductive layers 82, 84, 86, additional electrons may be released through secondary electron emission, such that the microchannel plate 44A acts as an electron multiplier. Additionally, electrons within the microchannel 62 encounter an electric field due to voltage differentials between the conductive layers 82, 84, 86. For example, the voltage differential between the middle conductive layer 84 and the lower conductive layer 86 produces an electric field component extending axially through the microchannel 62 that accelerates electrons toward the anode 58. Thus, the five-layer microchannel plate 80 acts as both an electron multiplier and an electron accelerator.

While the invention has been presented herein by way of an exemplary embodiment, equivalent structure may be substituted for the structures described here and perform the same function in substantially the same way and fall within the scope of the present invention. For example, while the alternative embodiment has been described as including a five-layer microchannel plate 82, the microchannel plate may include other numbers of layers, depending upon manufacturing, gain or other considerations. The invention is therefore described by the claims appended hereto and is not restricted to the embodiments shown herein.

We claim:

1. A field emission display comprising:

an emitter panel including a plurality of emitters and an extraction grid, the emitter panel emitting electrons in response to an electric field between the emitters and the extraction grid;

an anode positioned opposite the emitter panel;

a cathodoluminescent layer coating a surface of the anode facing the emitter panel; and a microchannel plate including a plurality of passageways therethrough, the electron multiplier being positioned between the emitter panel and the anode so that electrons emitted by the emitter panel pass through the passageways as they travel to the anode, the microchannel plate outputting electrons in response to the electrons received from the emitter panel so that electrons pass through the cathodoluminescent layer at a rate that is greater than the rate that electrons are emitted from the emitter panel wherein each of the passageways is aligned to a plurality of the emitters.

2. The field emission display of claim 1 wherein the anode is coupled to a first voltage, the grid is coupled to a second voltage below the first voltage and the emitters are selectively couplable to a third voltage below the second voltage.

3. The field emission display of claim 2 wherein the passageways include inner walls coated with a conductive layer, the conductive layer being connected to a plate voltage between the anode voltage and the grid voltage.

4. The field emission display of claim 1 wherein the planar plate includes a plurality of spaced apart conductive layers in a stacked configuration, each conductive layer being electrically isolated from the other conductive layers.

5. The field emission display of claim 4 wherein a first of the conductive layers is connected to a first plate voltage between the anode voltage and the grid voltage.

6. The field emission display of claim 5 wherein a second of the conductive layers is positioned intermediate the first conductive layer and the anode, the second conductive layer being connected to a second plate voltage between the anode voltage and the first plate voltage.

7. The field emission display of claim 6 wherein a third of the conductive layers is positioned intermediate the second conductive layer and the anode, the third conductive layer being connected to a third plate voltage between the anode voltage and the second plate voltage.

8. A field emission display comprising:

a display screen having an anode and a cathodoluminescent layer;

an emitter panel spaced apart from the display screen to define a gap therebetween, the emitter panel including an array of emitting sections oriented to emit electrons toward the display screen each emitting section including a plurality of emitters; and a microchannel plate positioned in the gap and oriented to intercept the electrons emitted toward the anode the microchannel plate including a dielectric plate having a first surface facing the anode, a second surface facing the emitter panel, and a plurality of passageways extending from the first surface to the second surface, wherein each of the passageways encircles a plurality of the emitters.

9. The field emission display of claim 8 wherein the microchannel plate includes a conductive layer covering inner walls of the passageways.

10. The field emission display of claim 9 wherein each of the passageways defines a guide for collimating emitted electrons.

11. The field emission display of claim 8 wherein the emitter panel includes:

a substrate supporting the emitters; and a conductive grid above the substrate, the grid including a plurality of apertures, wherein the grid is oriented such that the emitters project into the apertures.

12. The field emission display of claim 11 wherein the emitters are couplable to a reference voltage, the conductive grid is biased at a first voltage, above the reference voltage, the conductive layer is biased at a second voltage above the first voltage and the anode is biased at a third voltage above the second voltage.

13. A method of producing a viewable image in a field emission display having an emitter panel and a display screen positioned above the emitter panel, the emitter panel including emitters on a substrate and a grid, comprising the steps of:

biasing the grid at a grid voltage;

selectively coupling a plurality of the emitters to a reference voltage below the grid voltage to cause the plurality of emitters to emit electrons;

biasing the anode at an anode voltage higher than the grid voltage to cause the emitted electrons to travel toward the anode;

positioning a microchannel plate having a plurality of passageways therethrough between the emitters and the anode;

aligning the microchannel plate to the emitter panel with one of the passageways aligned to a selected plurality of the emitters;

biasing a microchannel plate at a plate voltage;

intercepting the emitted electrons traveling toward the anode with the microchannel plate to cause the microchannel plate to produce a multiplied set of electrons; and intercepting the electrons in the multiplied set of electrons with the cathodoluminescent layer to cause the cathodoluminescent layer to emit light, the emitted light producing the viewable image.

* * * * *